US008947178B1

(12) United States Patent
Reid, Jr.

(10) Patent No.: US 8,947,178 B1
(45) Date of Patent: Feb. 3, 2015

(54) DIELECTRIC CORE TUNABLE FILTERS

(75) Inventor: James R. Reid, Jr., Billerica, MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 414 days.

(21) Appl. No.: 13/208,718

(22) Filed: Aug. 12, 2011

Related U.S. Application Data

(60) Provisional application No. 61/373,037, filed on Aug. 12, 2010.

(51) Int. Cl.
*H01P 1/202* (2006.01)
*H01P 7/04* (2006.01)

(52) U.S. Cl.
CPC . *H01P 1/202* (2013.01); *H01P 7/04* (2013.01)
USPC ..... 333/207; 333/223

(58) Field of Classification Search
CPC ..... H01P 1/202; H01P 7/04
USPC ..... 333/206, 207, 202, 203, 222, 223
See application file for complete search history.

(56) References Cited

U.S. PATENT DOCUMENTS

| | | | | |
|---|---|---|---|---|
| 5,329,687 | A * | 7/1994 | Scott et al. | 29/527.2 |
| 5,859,575 | A * | 1/1999 | Hino | 333/206 |
| 6,150,905 | A * | 11/2000 | Nishijima | 333/206 |
| 6,801,106 | B2 * | 10/2004 | Ono et al. | 333/206 |
| 7,332,988 | B2 * | 2/2008 | Baleras et al. | 333/202 |
| 2010/0321132 | A1 * | 12/2010 | Park | 333/186 |

* cited by examiner

*Primary Examiner* — Benny Lee
*Assistant Examiner* — Jorge Salazar, Jr.
(74) *Attorney, Agent, or Firm* — AFMCLO/JAZ; Charles Figer, Jr.

(57) ABSTRACT

A dielectric core tunable filter for microwave frequencies of 0.5-30 GHz. The filter includes a low loss machined dielectric having multiple channels a portion of which are terminated in micro-electromechanical variable capacitors to realize coupled resonators. The machined dielectric is metalized with a material, such as copper, silver, or gold, and then patterned to provide ring shaped recesses at the ends of pre-selected channels.

13 Claims, 4 Drawing Sheets

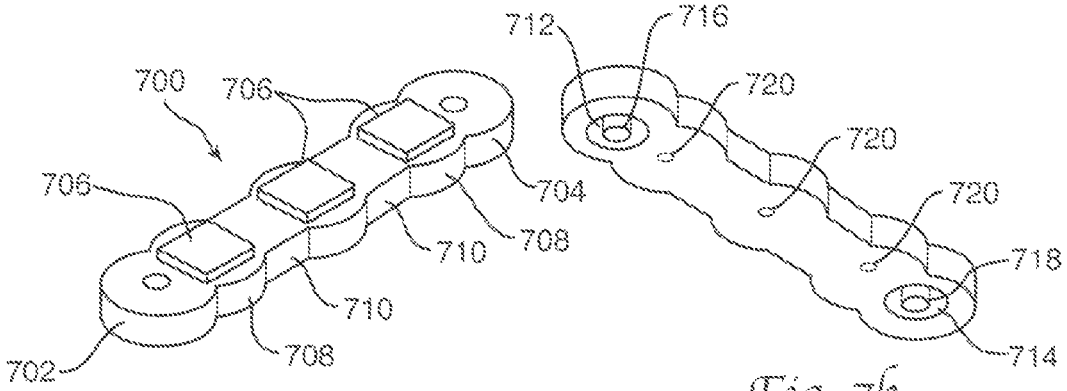
Fig. 7a
Fig. 7b
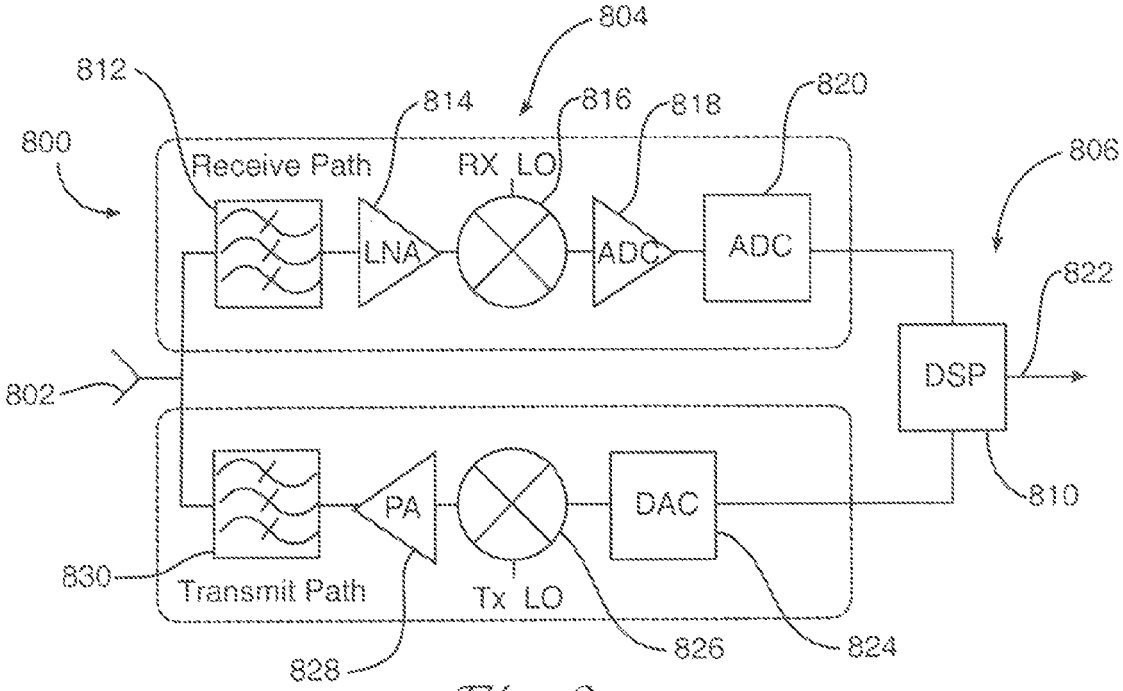
Fig. 8

DIELECTRIC CORE TUNABLE FILTERS

RIGHTS OF THE GOVERNMENT

The invention described herein may be manufactured and used by or for the Government of the United States for all governmental purposes without the payment of any royalty.

CROSS-REFERENCE TO RELATED APPLICATIONS

This application claims benefit of U.S. Provisional patent application Ser. No. 61/373,037, filed Aug. 12, 2010, titled "Dielectric Core Tunable Filters" to James R. Reid, the disclosure of which is expressly incorporated by reference herein.

BACKGROUND OF THE INVENTION

The present invention relates to tunable filters for electronic communication devices and apparatus and more particularly to high quality factor dielectric core tunable filters for microwave frequencies of from 0.5 to 30 GHz.

Tunable microwave filters have traditionally served a variety of niche applications in military and civilian systems, but recent advances in software defined radio have opened up significantly larger markets for this technology. Signals intelligence, or SIGINT, is the gathering of transmitted radio signals. It is considered essential to the conduct of all large scale military operations, and is widely used in identifying and locating targets. Traditional military applications include wide band receivers for SIGINT systems and electronic warfare. Commercially, these filters have primarily been used in the test and measurement equipment.

Electronic warfare is a fairly broad category that covers everything from jamming of communication and radar signals to radar spoofing and electronic attack. In general, electronic warfare systems require very rapid tuning (typically under one microsecond). In addition, many of these filters are used on transmit and therefore require significantly higher power handling. On transmit, insertion loss is a critical parameter, but isolation can often be relaxed so that lower quality factor technologies can be used. Currently this market is dominated by varactor tuned filters. In the late 1990's the concept of software radio began to move from a research concept to a widely deployed technology. Software radio offered the promise of multi-band, multi-function, and multi-mode radio systems. To date, software radio has delivered reasonably well on both the multi-function and multi-mode aspects, but has not truly delivered on the multi-band promise. Tunable filters are one of the technologies that have limited the success of software radios ability to provide multi-band solutions.

Current filter technologies are directed to Yttrium Iron Garnet (YIG), varactor, and ferroelectric types of filters. YIG filters are recognized as tunable filters that provide multi-octave tuning, low loss, and high selectivity. However, YIG filters are also recognized to have limited power handling, relatively poor linearity, slow tuning speeds, high drive power requirements, and poor thermal stability. Based on the advantages of YIG filters, it should not be surprising that they are widely used in Signals Intelligence (SIGINT), but are not suitable for many Electronics Warfare (EW) applications. Varactor tuned filters are recognized for their high speed tuning, but they have low quality factors and therefore can offer low loss or high selectivity, but not both. These filters are commonly found in applications such as EW where high speed tuning is critical. Recently, tunable filters fabricated using ferroelectric thin films (primarily barium strontium titanate) have been developed. These filters have shown higher quality factors compared to varactor filters and higher speed than YIG filters.

Other filters include the combline filter which is a widely used filter implementation. Typical combline filters are formed from machined aluminum parts. Resonators are formed from square or circular cavities with posts protruding up from the base. Typically the posts are circular and are enclosed in square cavities. The filters are commonly plated with silver to reduce the losses. The vast majority of these filters are not tunable.

Ceramic filters and resonators are also known and widely used in industry. These filters are typically made from multiple (2-8) individual resonators that are coupled together via an external circuit.

Barium strontium titanate (BST) filters use a combline structure that is tuned and loaded by a capacitor fabricated with barium strontium titanate. One example can be found in U.S. Pat. No. 6,801,104, entitled "Electronically Tunable Combline Filters Tuned by a Tunable Dielectric Capacitor".

SUMMARY OF THE INVENTION

The present invention includes high quality factor dielectric core tunable filters for microwave frequencies (0.5-30 GHz). When compared to competing tunable filters, the filters detailed here offer excellent performance in terms of insertion loss, isolation, drive power, tuning range, tuning speed, and volume. In addition, these filters can offer comparable to lower costs for manufacturing, higher power handling, and smaller volumes. These advantages come from a design approach that employs a low loss machined dielectric such as quartz, alumina, ceramics, or sapphire combined with a low effective series resistance (<<0.1 ohms) micro-electromechanical (MEM) variable capacitor to realize coupled resonators with high unloaded quality factors (Qu >1,000). These aspects provide a wide range of resonator coupling approaches, limited only by the ability to machine the dielectric. Using current technology, this approach is suitable to filters operating in the 0.5-30 GHz frequency range (wavelength: 600 mm $<\lambda_0<$10 mm).

The described filters can provide advantages over competing technologies. For instance, the present invention can provide high Q (Qu >1,000), high speed (tuning in under 1 microsecond), and high power handling(>25 watts). In addition to this combination of performance critical features, the filters can provide low drive power in a moderately compact volume.

The present filters include center frequencies ranging from 1.6 GHz to 15 GHz. Additionally, the present filters include dielectric core resonators instead of air core resonators. As a result the newer filters can be more compact than an equivalent air core filter by a ratio of $1/\sqrt{\epsilon_r}$ in each of three spatial axes. Furthermore, the manufacturing of these new filters does not require three dimensional micromachining and instead can be made with drilling, high precision machining, or laser etching. Additional fabrication techniques can also be used. Finally, these filters are useful over a significantly different frequency range.

This technology uses a series of holes drilled into a single piece of dielectric material to form a tunable filter. Each of the holes creates either a resonator or an impedance matching network with the space between the holes forming the coupling network. The filters are formed from a set of interconnected resonators coupled to an input and output matching network. The presently described filters include resonators formed by machining quartz to form a transmission line with one end short circuited, and a second end open. The open end of the transmission line is then closed using a variable capacitor in a shunt configuration. The result is a transmission line resonator with a variable frequency controlled by electronically adjusting the capacitance.

According to one aspect of the present invention there is provided a filter for filtering microwave frequencies including a filter body, having a filter body outer surface and plurality of channels disposed within the filter body, each of the plurality of channels, extending through the filter body, and having a first end and a second end and a channel surface disposed there between. The filter body outer surface and channel surface include a metalized surface, and at least two recesses, each one being disposed at a same end of at least two of the plurality of channels. At least one microelectromechanical (MEM) capacitor is disposed on the filter body outer surface at one of the at least two recesses.

Pursuant to another aspect of the present invention there is provided a method of fabricating a tunable filter comprising the steps of selecting a dielectric material having an outer surface including a first surface and a second surface, forming a plurality of channels in the dielectric material extending from the first surface to the second surface and extending through each of the first and second surfaces, metalizing the dielectric material including the plurality of channels, forming a plurality of recesses around the plurality of channels, and bonding a variable capacitor at a some of the plurality of recesses.

BRIEF DESCRIPTION OF THE DRAWINGS

FIGS. 7*a* and 7*b* illustrate another embodiment of the present invention.

FIG. 8 illustrates a software defined radio using a filter of the present invention.

DETAILED DESCRIPTION OF THE INVENTION

Figure 1:
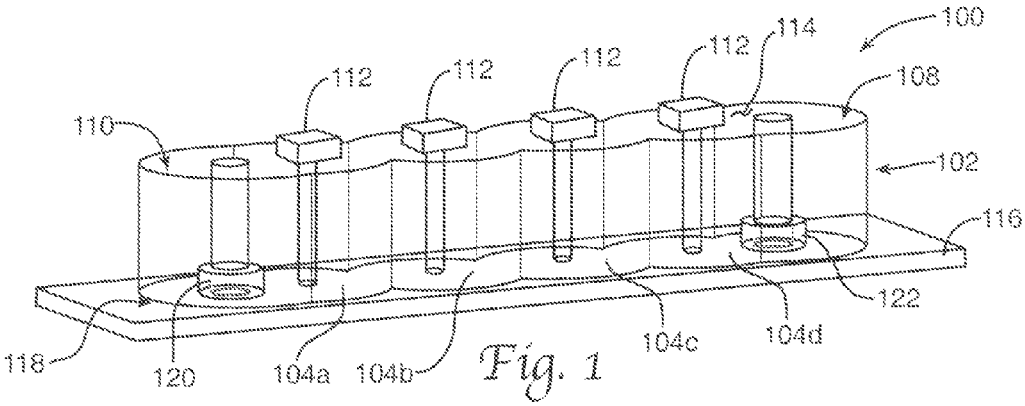
FIG. 1 illustrates a perspective view of one embodiment of a filter of the present invention.

FIG. 1 illustrates a perspective view of one embodiment of a filter 100 of the present invention. The filter 100 includes a resonator structure 102 which can be made of a dielectric material, such as quartz, which can be ultrasonically machined to form a plurality of individual resonators 104*a*, *b*, *c*, and *d*. The resonator structure 102 also includes a first input/output matching section 108 and a second input/output matching section 110. Electrically controllable variable capacitors 112 are mounted to a first side 114 of the resonator structure 102 and an input/output circuit board 116 is mounted to a second side 118 of the resonator structure 102. The result is a transmission line resonator with a variable frequency controlled by electronically adjusting the capacitance. In one embodiment, the variable capacitors include one or more MicroElectroMechancial system (MEMS) devices.

The resonator structure 102, as shown in FIG. 1, provides a quartz transmission line structure machined from the material to form the resonator structure 102. Initially, the structure 102 is drilled from the first side 114 through the second side 118 such that each of the five sections of the resonator structure 102 include a single channel or hole having a consistent diameter from one side to the other. The channels extend completely through the dielectric material and are substantially perpendicular to one of the sides 114 or 118 and are substantially parallel with each other.

Once the channels have been formed, the structure 102 is metalized on all exposed surfaces to provide an electroplated structure having a plating of approximately 1 mil thick. In one embodiment, copper is used in the electroplating process; however, other metals such as silver and gold may also be used. After metallization, second side 118 is patterned at the channels located at either end of the structure 102. The patterning, which can be made by laser etching, provides an input/output port 120 and an input/output port 122, by creating a ring shaped or "doughnut" shaped recess around the channels extending into and through the resonator structure 102 at either end thereof. Additional details and other possible embodiments will be described in more detail in FIGS. 2, 6*a*-*d*, and 7*a*-*b*.

Figures 2A, 2B, 2C, 2D, 2E:
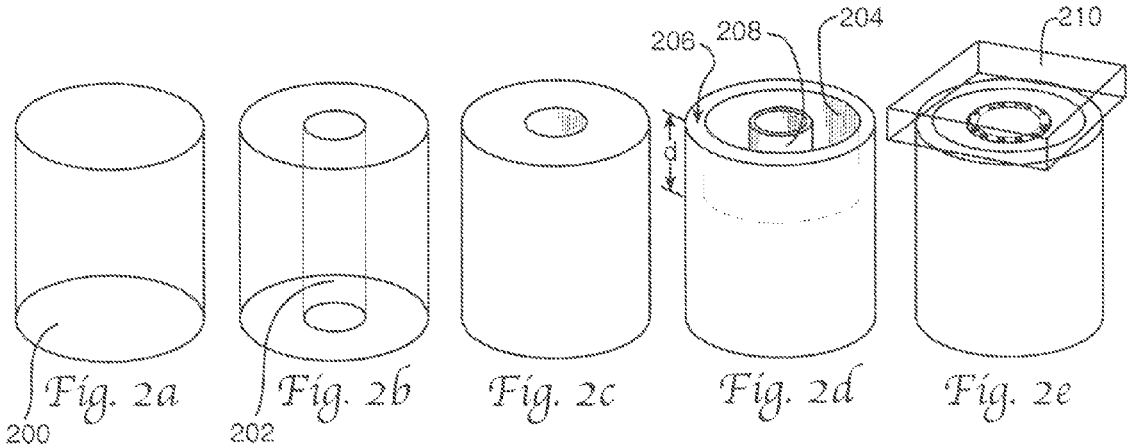
FIGS. 2*a*-2e illustrate one possible fabrication process to make a resonator of the present invention.

FIGS. 2*a*-2*e* schematically illustrate one possible fabrication process for creating a single resonator which can be applied to resonator structures having at least one resonator and one or more input/output ports. A dielectric material, such as a piece of quartz 200, here illustrated as a cylinder in FIG. 2*a*, although other shapes and dimensions are within the scope of the present invention, is altered by placing a channel 202 through the length thereof by drilling along the axis of the cylinder and entirely through the quartz material in FIG. 2*b*. At this step of the process, an unmetalized dielectric core for a coaxial transmission line has been formed. In FIG. 2*c*, the altered cylinder is substantially covered in its entirety with a thin layer of metal. While a cylindrical shape is shown for the channels other shapes are within the scope of the present invention.

Figure 3:
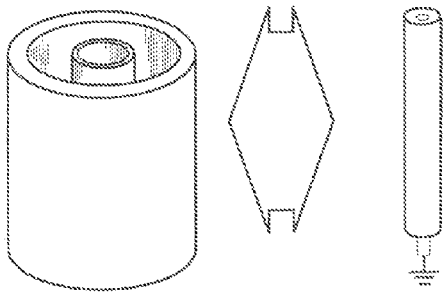
FIG. 3 illustrates a schematic equivalent circuit of a resonator of the present invention.

Electrodeposition using copper can be used to deposit the metal on all of the exposed quartz surfaces including the wall of the channel. In FIG. 2*d*, a donut or ring shaped recess 204, is formed in a top side 206 of the quartz 200. As can be seen, the recess 204 extends a distance d (not to scale) into the cylinder 200 to thereby create a tube 208 centrally located within the recess 204. It is preferred that only the metal is removed to create the recess. At this point, the device is a coaxial transmission line with one end (the fully metalized end) open, and the second end (with the ring shaped opening) open. Schematically (see FIG. 3) this can be drawn as a short circuited or grounded coaxial line. The metal running through the center of the cylinder is the signal line, and the metal on the outside is the ground line.

In the next step, as illustrated in FIG.2*e*, a controllable variable capacitor 210 is flip chip mounted to the top side 206 of the dielectric material to form a resonator. Adding the variable capacitor 210 to the open end of the line results in a tunable resonator. The capacitor 210 is illustrated to show the location of the channel with respect to the capacitor. The resonator has a frequency determined by a combination of the length of the line and the capacitance of the controllable variable capacitor. Note that in the configuration shown, there is no structure to couple signals into or out of the resonator.

Figure 4:
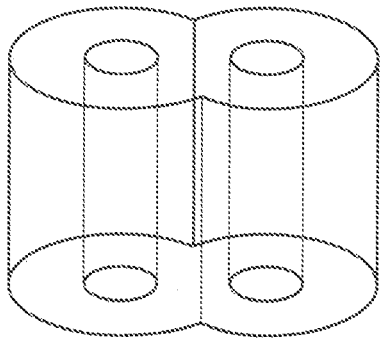
FIG. 4 illustrates a schematic view of a coupling of two resonators.

Coupling resonators together can be accomplished by placing the resonators side-by-side so that an open region forms in the ground plane as illustrated in FIG. 4. In a virtual design environment, this is easily accomplished by simply setting the spacing between two signal lines to be less than the diameter of the ground line as shown in FIGS. 6*a-d*. Through the use of calculations and circuit simulations, the coupling between the lines can be accurately predicted to design a filter. Coupling can be considered to be a function of the distance between the signal lines, the width of the opening in the ground line, and the direction of propagation of the signals (open ends on the same face, or on opposite faces).

Coupling multiple resonators together can be accomplished by extending the example of two resonators to an arbitrary number of resonators within a filter. It should be noted, that moving from two resonator coupling to multiple resonator coupling, can in some cases, require taking into account the coupling between nonadjacent lines. This additional coupling can be accurately simulated with a variety of full wave electromagnetic simulation tools to provide practical filters.

A filter design process of the present invention includes four steps: (1) selecting the design method; (2) creating a mathematical model; (3) mapping the mathematical model to a circuit model; and (4) mapping the circuit model to a physical implementation. The first three steps are known by those skilled in the art, while the fourth step provides an inventive filter method, device and apparatus. Designing filters of the present invention can be accomplished with a variety of methods, mathematical models, and circuit models. For instance, one method can include an insertion loss design method to create an equal ripple (Chebyshev Type 1) filter. The circuit model used for all six filters in Table 1 below is that of a combline or transitional combline-evanescent mode filter. While these implementations provide an example of the presently described filters, the present invention is not limited to this design method, mathematical model (Chebyshev Type 1), or circuit implementation. Indeed, designing generalized Chebyshev and pseudo-elliptic filters is possible with the present invention. Further, circuit implementations including interdigital filters can also be made. Table 1 provides a summary of a number filter designs possible according to the present invention

TABLE 1

| Design | Prototype | Center Frequency | Bandwidth (%) | Poles | Material | Thickness |
|---|---|---|---|---|---|---|
| 1 | 0.1 dB | 3.0 GHz | 3.10 | 4 | Quartz | 5.5 mm |
| 2 | 0.03 dB | 10.0 GHz | 2.88 | 3 | Quartz | 1.6 mm |
| 3 | 0.03 dB | 10.0 GHz | 1.90 | 3 | Quartz | 1.5 mm |
| 4 | 0.03 dB | 2.0 GHz | 1.02 | 4 | Quartz | 8.0 mm |
| 5 | 0.04 dB | 1.5 GHz | 2.70 | 2 | Quartz | 11.0 mm |
| 6 | 0.04 dB | 15.0 GHz | 2.60 | 2 | Quartz | 1.0 mm |
| 7 | Resonator | 10.0 GHz | N/A | 1 | Quartz | 1.5 mm |

Figure 5:
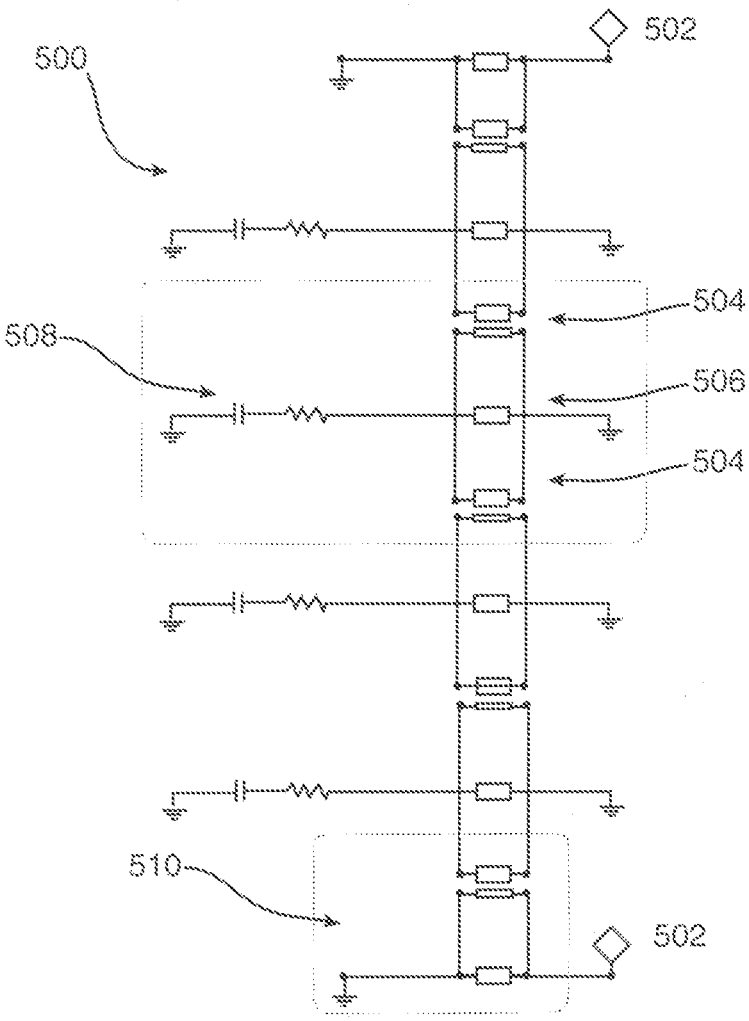
FIG. 5 illustrates a circuit schematic for a four-pole filter

Mapping the mathematical filter design to a combline filter circuit model is done by calculating the capacitances between each signal line and its neighboring signal lines, and each signal line and the ground. Once these capacitances are calculated, the even and odd mode impedances of the lines are calculated and a circuit design is implemented. FIG. 5 shows the circuit design 500 implemented for a four pole filter having two I/O ports 502, line-line coupling 504, line-ground coupling 506, terminating capacitors 508, and a matching network 510.

Fabrication of the filter includes selecting a dielectric material, machining the dielectric, metalizing the dielectric, etching holes in the metal coating, and bonding the variable capacitors onto the filter. Each step in the process should be carefully controlled for accuracy and the variable capacitors should be selected, or designed, to provide the proper range of capacitance for each resonator.

Fabrication of the filter should also include a consideration of the type of dielectric. For instance, when selecting quartz as the dielectric, the type of machining processes should be considered as well as the choice of the design of the variable capacitors. Other dielectrics such as sapphire or magnesium oxide can be used with a similar fabrication approach. Other dielectrics (such as those offered by Murata) can be pressed or sintered into the desired filter shape without the need for further machining.

The first step in the process is to choose an appropriate dielectric. Fused quartz (and/or fused silica, a synthetic equivalent) is available from a number of suppliers, including GEI, Saint Gobain, TOSOH Quartz, Heraeus Quarzglas, QSIL. Most of the suppliers supply electrically fused quartz, flame fused quartz, and fused silica. Measurements of all three varieties from multiple manufacturers would be required to determine the required properties, but references suggest that fused quartz is preferable to fused silica in terms of electrical loss tangent. Typically a single vendor can provide both the quartz and the machining. At low frequencies, this typically means using quartz ingots that are then fused and machined, but at high frequencies, it can mean using quartz wafers that are machined.

A number of machining techniques can be used including laser machining and computer numeric control (CNC) machining.

Once the quartz parts have been machined to the desired shape, including placement of the channels as well as the filter's outside configuration and dimensions, then the metallization step is performed. One type of metallization process includes a silver mirroring process similar to that used since the 19th century for depositing silver coatings on glass to create mirrors. This process reacts silver nitrate in a solution resulting in a silver precipitate that sticks to clean surfaces leaving a high quality pure silver surface. This process is suitable for depositing a thin layer of silver on the order of 0.1 micrometer thick on all of the quartz surfaces, including the channel which passes through the quartz body. This film can then be used as the plating base in a silver electroplating process to deposit 5 to 25 micrometers of silver on all surfaces. Then a thin layer of gold (0.1-1.9 micrometers thick) can be deposited using either electroplating or electroless plating.

Opening recesses around the channels in the metal can be made by laser etching. Tools for laser etching are available and commonly used for things like marking tools or engraving keepsakes. The laser needs to be properly set up to etch the silver without doing significant damage to the quartz. It is also important to get smooth lines during the laser etching process.

Finally, the variable capacitors are bonded onto the filters using a technique such as thermocompression bonding, solder attach, conductive epoxy attach, or compression bonding. The capacitors are bonded to align with the etched holes. Bonding is done by using pressure of approximately greater than 1 Megapascals and a temperature of approximately greater than >300° C. for a short time period of time. The heat and pressure fuses together the gold that was previously deposited on the two mating surfaces. The final bond is extremely strong and provides a very low electrical resistance.

Figures 6A, 6B, 6C, 6D:
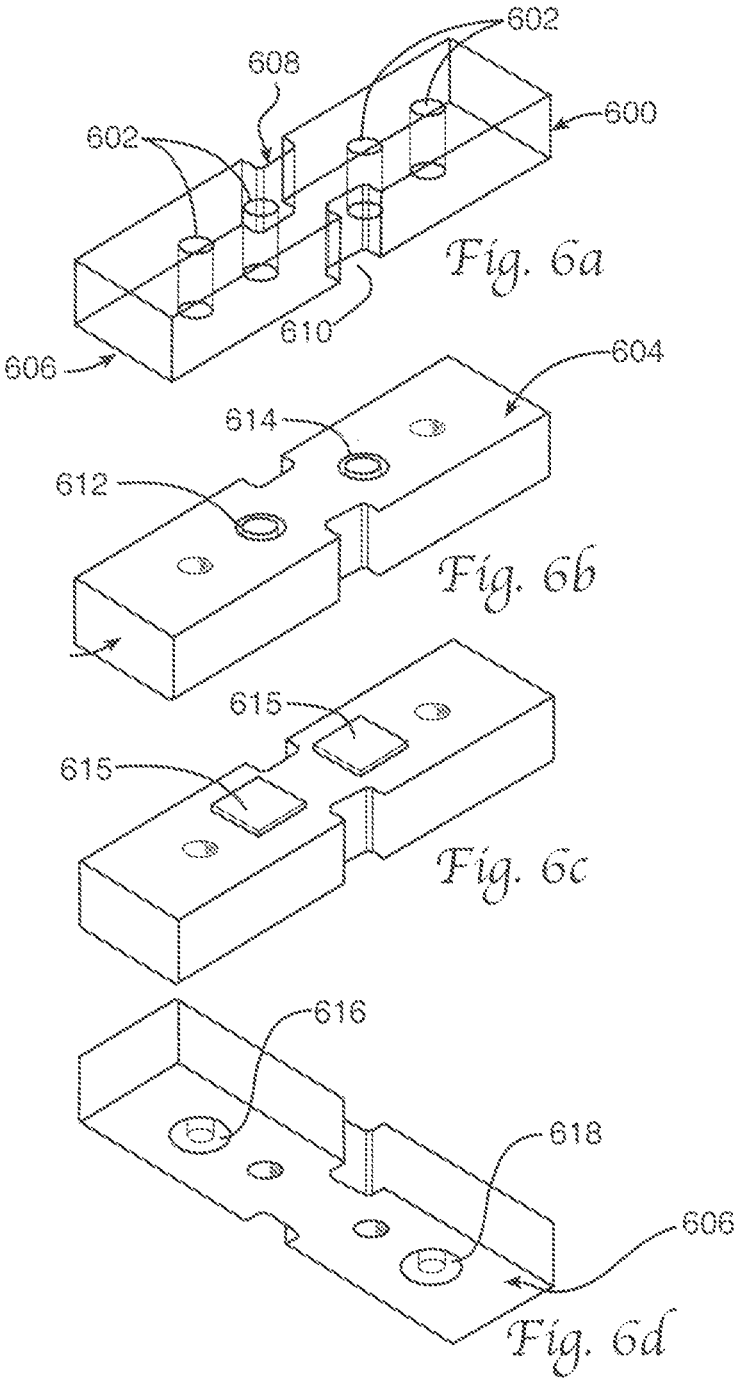
FIGS. 6*a*-6d illustrate one embodiment of a filter body of the present invention.

FIGS. 6*a*-d illustrate one embodiment of the present invention. In FIG. 6*a*, a dielectric body 600 is machined using CNC machining or laser machining. For filters in the 4-18 GHz range, the preferred material is fused quartz. Preferred materials for filters operating in the 1-4 GHz range is high purity (99.6% or better) Alumina. Alternate dielectrics include all low loss ceramic materials, including sapphire, boron nitride, magnesium oxide, and a range of commercially available microwave ceramics. As can be seen a plurality of channels 602 have been formed extending from a top surface 604, through the body, and to a bottom surface 606. In addition the quartz body has been formed to include a first notch 608 and a second notch 610 which can be used as mounting structures for placement in an electronic device.

All surfaces of the dielectric of FIG. 6*a* are then metalized with a low loss metal. Such metals include silver, copper, and gold. The described silver mirroring process can be used to create an initial thin coating on all surfaces of approximately 0.1-0.5 micrometers, followed by plating a thicker 5-25 micrometer layer. A final outer protective coating of 0.5-5.0 micrometers of gold is added to passivate the outer surface.

In FIG. 6*b*, a first recess 612 and a second recess 614, are laser etched or ion milled in the top surface 604 in the two inner channels 602. Similar recesses (not shown) are formed on the opposite surface 606 at each of the channels located at either end of the dielectric body 600. The two interior channels, disposed between the outer channels are used as capacitor loading ports and the two outer channels are used as input/output ports. One or more interior channels can be included.

In FIG. 6*c*, MEMS actuators or capacitors 615 are bonded to the gold plated surface area, surrounding the two inner channels using either a solder (AuTn, InAu) or by a direct thermal compression bonding process FIG. 6*d* illustrates the bottom surface 606 of the body 600. As can be seen an input/output port 616, 618 have been formed. The tuning speed of the filter is set by the tuning speed of the MEMS capacitor. The MEMS variable capacitors can include a mechanical resonant frequency of approximately 25 kHz. Using a properly controlled waveform, these filters can be tuned from any frequency to any other frequency in exactly one half of a cycle. Therefore, these filters can be tuned to any frequency in approximately 20 microseconds. Faster MEMS variable capacitors can be achieved by increasing the mechanical resonant frequency. A tuning speed below 5 microseconds is readily achievable, and speeds below 1 microsecond can be achieved but may sacrifice performance in terms of tuning range.

It has been determined that dielectric breakdown of the quartz is not going to be a problem even up to power levels over 25 Watts. Surface breakdown can, however, be more of a concern. Cleaning the quartz can be done using a variety of techniques, well known by those skilled in the art. Breakdown in the air is more problematic, but can be dealt with by sealing the capacitors in the proper gas and limiting open areas to prevent multipaction. Based on current MEMS variable capacitor designs, it is reasonable to project that 10 milliwatt power levels will not provide a significant problem. It is believed that MEMS variable capacitor designs sufficient to handle 200V (RF peak) and up to 5 watt filters can readily be achieved. It is also possible with additional design efforts to MEMS variable capacitor designs that 5 watt to 25 watt can be achieved.

Table 2 provides examples of the volumes of the filter bodies only. To include the volume of the variable capacitors, the height of the filter should be increased by 0.5 mm. Note that this will have a major impact on the high frequency filters, but a very minimal impact on the low frequency filters. In addition, it is important to realize that volume should be normalized to the wavelength since a 10 GHz filter will almost always be smaller than a 2 GHz filter. Volume can be decreased by reducing the number of poles, or using a TEM mode filter.

TABLE 2

| Design | Length (cm) | Width | Height | Volume ($cm^3$) |
|---|---|---|---|---|
| 1 | 4 | 0.9 | 0.55 | 2.16 |
| 2 | 2.4 | 0.45 | 0.16 | 0.23 |
| 3 | 3.3 | 0.5 | 0.15 | 0.33 |
| 4 | 5.5 | 4.4 | 0.8 | 20.6 |
| 5 | 7.85 | 2.05 | 1.1 | 18.5 |
| 6 | 1.25 | 2.5 | 0.1 | 0.47 |

FIGS. 7*a* and 7*b* illustrate another embodiment of the present invention which includes a three resonator rounded micromachined dielectric filter 700. FIG. 7*a* illustrates a top perspective view of the filter 700 including respectively a first and second input/output matching section 702 and 704, a plurality of variable capacitors 706, each of which has been bonded to the top surface of the filter body and over the previously defined recesses, first, second, and third resonators 708, and resonator coupling sections 710 separating the two end resonators from the middle resonator.

FIG. 7*b* illustrates a bottom perspective view of the filter 700. In particular to illustrate an input/output port 712 and an input/output port 714 each of which includes the previously described recess formed around channels 716 and 718. Individual channels 720 for each of the resonators can also be seen extending through the bottom surface.

Besides SIGINT and electronic warfare applications for the described resonators, another application for the described resonators can include software defined radio (SDR). A growing demand for the wireless transmission of voice, data, and video has resulted in the development of a large number of radio systems. Traditional radio systems were designed specifically to operate only with other radios from the same system. The dramatic increase in the capabilities of digital processors over the last two decades has now made it possible to move many of the radios functions into the digital domain. Indeed using programmable digital processors, it is now possible to implement most of a radio's functions in software, so that simply changing a procedure call can redefine the operating parameters of the radio. This new kind of radio is alternately called digital radio, software radio, or software defined radio. The goal of moving to SDR is to make the radio more flexible, and specifically develop multi-user, multi-band, multi-function, and multi-waveform radios.

Generally radios are composed of three sections, one schematic example of which is illustrated in FIG. 8. An SDR 800 includes an antenna 802, a front end 804, and a back end 806 (or baseband). Each of these sections is responsible for providing a specific function for the overall radio system. For simplicity, the functions of these sections are described in the context of a receiver, however, it should be noted that each block serves the same function in reverse for a transmitter. The receive chain begins with free space waves arriving at the antenna 802. The antenna 802 converts these free space waves into guided waves that can be processed in the radio system. The front end 804 takes the guided waves from the antenna and prepares them for demodulation by the back end 806. This preparation is dependent on the type of radio system, but typically involves, filtering the guided waves to remove undesired signals, amplifying the desired frequencies, and then converting frequency range from one that is suitable for propagation in free space (typically a high frequency) to a different frequency range that is better suited to demodulation (typically a lower frequency). The back end 806, or baseband, then extracts information (demodulates) from the prepared signals provided by the front end. It should be noted that in an SDR, all of the backend functions are now performed in software, here indicated as a digital signal processor (DSP) 810.

Depending on size, weight, power, and cost some of the front end capabilities are also implemented in the digital domain. From an RF point of view, there are several critical design issues that arise from this configuration. An RF front end is now required to meet the most demanding requirements for all of the radio system standards that the radio will support. This is a more significant issue that might be appreciated at first glance. Consider that some standards require the system be able to detect very low power signals while other standards require the system to transmit and receive at much higher powers. Further, some modulation schemes have very stringent linearity requirements. As a result, the front end must be designed to have good linearity, high dynamic range, moderate to high transmit power, and a low minimum detectable signal. A second area of concern is that the antenna 802 and the front end 804 now must operate over a much wider bandwidth. As a result, signals that would have previously been filtered out by both the antenna 802 and a pre-selector filter are now in the operating range of the radio.

The traditional role of a pre-selector (band selection) filter is counter to the goal of making multi-band radios. Eliminating the pre-selector filter, however, opens the radio up to more interference and dramatically increases the dynamic range requirements on the receiver. Not surprisingly, software defined radios still use (and require) pre-selector filters. Multi-band operation is achieved by switching between multiple front ends. Ideally, a tunable filter 812, as described herein, is used as a preselector filter. The tunable preselector filter 812 can enable software defined radios for concepts such as cognitive radio and dynamic spectrum allocation.

The filter 812 would tune over the entire desired frequency range and provide the desired band to a single low noise amplifier (LNA) 814. The bandwidth of the preselector would be chosen based on the maximum bandwidth of any signal the radio system is designed to support. For most microwave systems, the maximum transmission signal bandwidth would be in the range of 1-50 MHz. After the first LNA 814, the signal can be mixed down in frequency by a receiver local oscillator (RX LO) 816 whose output signal is coupled to an analog/digital converter amplifier 818 which in turn is coupled to, converted, and processed depending on different system design requirements by an analog/digital converter 820. The filters detailed in this document are ideally suited to just this role.

The output of the ADC 820 is coupled to the digital signal processor 810 where all defined signal processing occurs as is understood by one skilled in the art. The output of the DSP 810 can be obtained at an output 822 as understood by those skilled in the art.

The radio 800 of FIG. 8 also includes a transmit portion which receives a digital signal from the DSP 810 at a digital/analog converter 824 having an output coupled to a transmitter local oscillator (TxLO) 826. The TxLO 826 is coupled to a high power amplifier 828 for providing sufficient power for transmission of the signal at the antenna 802 after being conditioned at a tunable transmit filter 830.

The potential of software defined radio has been widely recognized in the department of defense (DOD). Specifically, the Joint Tactical Radio program aims to develop of family of SDRs to replace all of legacy radio systems currently operated by the US military. Beyond joint tactical radio, software defined radio provides new possibilities at the network and operations levels.

It is worth noting that a dielectric core and the circular hole or channel projecting all the way through the dielectric provides critical design points. Projecting the channel all the way through the core makes manufacturing significantly easier. Further, a dielectric core provides size reduction, improves RF power handling, and provides the physical structure of the device. In addition, the use of a single dielectric for both the resonators and the resonator coupling offers substantial advantages for the filter. By using a single dielectric, the filter achieves superior mechanical rigidity and fewer independent parts.

While an exemplary embodiment incorporating the principles of the present invention has been disclosed herein, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

what is claimed is:

1. A filter for filtering microwave frequencies comprising:

a filter body having:

an outer surface;

a plurality of channels disposed within the filter body, each of the plurality of channels extending with a constant diameter through the filter body and having a first end, a second end, and a channel surface disposed therebetween;

a recess formed surrounding a channel of the plurality of channels and extending into the filter body thereby creating a tube located within the recess, the recess disposed at the first end of the channel of the plurality of channels; and a micro-electromechanical (MEM) capacitor disposed on the filter body outer surface at the recess, wherein the filter body outer surface and the channel surface have a metalized surface.

2. The filter of claim 1, wherein the each of the plurality of channels extends entirely through the filter body.

3. The filter of claim 1, wherein the channel of the plurality of channels is a first channel and the recess is a first recess, the filter body further including a second channel of the plurality of channels having a first end and a second end, the second channel being proximate to the first channel and including a second recess recess being disposed at the second end of the second channel.

4. The filter of claim 3, wherein the filter body further includes a third channel of the plurality of channels having a first end and a second end, the third channel being proximate to the second channel and including a third recess being disposed at the second end of the third channel.

5. The filter of claim 4, wherein each of the first, second, and third recesses are substantially ring shaped and disposed substantially centered around an end of each of the first, second, and third channels respectively.

6. The filter of claim 5, wherein the second and third channels respectively include a first input/output channel disposed at a first end of the filter body and a second input/output channel disposed at a second end of the filter body.

7. The filter of claim 6, wherein the filter body outer surface includes a top surface and bottom surface, wherein the first recess is disposed on the top surface and the second recess and the third recess is disposed on the bottom surface.

8. The filter of claim 7, wherein the top surface and the bottom surface are substantially parallel to each other.

9. The filter of claim 8, wherein the first, second, and third channels are substantially perpendicular to the top surface and the substantially parallel to each other.

10. The filter of claim 9, wherein the at least one MEM capacitor is disposed at the first recess.

11. The filter of claim 10, wherein the at least one MEM capacitor includes a controllable variable MEM capacitor.

12. The filter of claim 1, wherein the MEM capacitor is a controllable variable MEM capacitor, the filter body further comprising:

two channels of the plurality of channels forming input/output channels;

two or more channels of the plurality of channels forming interior channels, wherein the controllable variable MEM capacitor is disposed on the filter body outer surface at the first end of one of the two or more interior channels; and one or more additional controllable variable MEM capacitors respectively disposed on the filter body outer surface at the first end of each of the other of the two or more interior channels.

13. The filter of claim 1, wherein the metalized surface includes at least one of silver, copper, and gold.

* * * * *